United States Patent [19]

Clark et al.

[11] Patent Number: 4,502,675

[45] Date of Patent: Mar. 5, 1985

[54] LONGITUDINAL FOLDING OF WEBS, FOLDING BOARD SYSTEM THEREFOR

[75] Inventors: Gerald L. Clark, Gwinnett County; Terry P. Ford, Cherokee County, both of Ga.

[73] Assignee: Kimberly-Clark Corporation, Neenah, Wis.

[21] Appl. No.: 514,068

[22] Filed: Jul. 15, 1983

[51] Int. Cl.[3] ..... B41L 1/30

[52] U.S. Cl. ..... 270/40; 270/41

[58] Field of Search ..... 270/40, 41, 5

[56] References Cited

U.S. PATENT DOCUMENTS

| | | | |
|---|---|---|---|
| 3,291,478 | 12/1966 | Couzens et al. | 270/40 |
| 3,291,479 | 12/1966 | Greiner et al. | 270/40 |
| 3,401,927 | 9/1968 | Frick et al. | 270/40 |
| 3,401,928 | 9/1968 | Frick | 270/40 |
| 3,472,504 | 10/1969 | Murphy et al. | 270/40 |
| 3,542,356 | 11/1970 | Murphy et al. | 270/40 |
| 3,679,094 | 7/1972 | Nissen et al. | 270/40 |
| 3,817,514 | 6/1974 | Nissen et al. | 270/40 |
| 4,052,048 | 10/1977 | Shirasaka | 270/40 |
| 4,131,271 | 12/1978 | Slawny | 270/40 |

*Primary Examiner*—E. H. Eickholt

*Attorney, Agent, or Firm*—Gregory E. Croft

[57] ABSTRACT

Longitudinal folding of flexible web into four substantially equal sections without the occurrence of undesirable wrinkling of the surface of the folded sections is effected by a longitudinal folding board system. The folding board system employs a secondary folding board for initiating folding a first section of the web into parallel relationship with a second section to form a double-folded half section of the web. The web moves over the top surface of the secondary folding board; and the first section of the web is diverted from the remainder of the web along a given angular path. A primary folding board, positioned at an incline downstream from the secondary folding board is used to redirect the path of travel of the second and fourth sections of the web from paths of travel under the primary folding board of paths of travel about boundaries of the primary folding board such that the second section of the web is folded adjacent to the first section about a longitudinal fold line axis forming the double-folded half section of the web while the fourth section is folded under the third section along a horizontal path. A folding rod is used to guide the double-folded half into an overlaying parallel relationship with the third and fourth sections. An additional folding means is employed to displace the first section from the second section of the web keeping the section fully extended in both the cross and machine directions as the double-folded half of the web is guided over and onto the third section to form a W-type longitudinal fold. A second embodiment of the device is also disclosed.

8 Claims, 15 Drawing Figures

(PRIOR SYSTEM)

LONGITUDINAL FOLDING OF WEBS, FOLDING BOARD SYSTEM THEREFOR

BACKGROUND OF THE INVENTION

1. Field of Invention

The present invention relates generally to folding board systems for producing longitudinal folds in web material and particularly to "W−" folding board systems of a novel form capable of automatically folding web material lengthwise along three parallel fold lines into four equal sections, the resulting folded sections being virtually free of undesirable wrinkles and creases along the section edges and within the interior surface.

2. Description of Background Art

In prior "W−" type folding board systems, various folding board configurations have been used to impart three (3) parallel longitudinal folds in web material such as tissue paper to produce "W−" and inverse "W−" folds, the inverse "W−" fold being the mirror image of the "W−" fold. The "W−" and inverse "W−" folds are formed using left- and right-hand folding board systems respectively, the structure of the left- and right-hand board systems being identical except for the components of the respective systems being disposed in mirror relationship. In use, a series of right-hand systems are positioned in front of left-hand systems, forming a tandem network of folding boards which enables interleaving "W−" with inverse "W−" folded webs. Also a plurality of tiers of tandem networks are formed so that longitudinal multifolding of a plurality of rolls of web material can be effected. When a suitable amount of multifolded interleaved webs are accumulated, the folded webs are cut to a chosen length and inserted into cardboard dispensing cartons as stacks of multifolded interleaved wipers without having connecting perforation tabs therebetween to form packages of dispensable wipers. Dispensing cartons usually have dispensing ports exposed so that efficient "pop-up" sequential dispensing of wipers from the carton can be effected.

Many of the prior techniques for making longitudinal folds have been quite suitable for forming substantial parallel folded sections in multifolded webs but wrinkled sections of folded webs have persisted.

An illustrative environment where application of the principles for the present invention is particularly advantageous is in a system employing two successively positioned folding boards for folding the webs; mainly, a secondary folding board and a primary folding board. Both right- and left-hand folding boards of each kind are used in this system. Left-hand secondary boards are used with left-hand primary folding boards, while right-hand secondary boards are used with right-hand primary folding boards. The left-hand system produces the mirror image of the right-hand system. To prevent describing substantially duplicate structure, only the right-hand system will be described extensively.

In an initial off-the-roll web, the width of each web, illustratively 17 inches, can be considered subdivided into four $4\frac{1}{4}$ inch width sections; namely, first, second, third and fourth sections respectively, when viewing the web in a horizontal plane from a left edge or "0" edge to a right edge with the first, second and third fold lines disposed in between.

The secondary board is a conventional starter board of the type described in U.S. Pat. No. 3,817,514 to Nisson et al. dated June 8, 1974, but for "W−" folds, it is used to initiate a fold along the first fold line by changing the plane of travel of the first section from a first horizontal plane to a counterclockwise angle of twist of approximately 90 degrees to a first vertical plane.

The primary folding board is a conventional "Z−" folding board of the type which may be configured from the one described in U.S. Pat. No. 3,401,928 to R. H. Frick dated Sept. 17, 1968. This folding board, illustratively provides structure capable of folding the fourth section under the third section while folding the first and second section over the third section as the web travels in the machine direction. During travel over the primary folding board, a guide rod is provided to guide the double panels; e.g., the first and second sections into an overlaying relation with the third section.

In past folding-board systems wherein the web traveling in the machine direction passes over the top surface of the secondary board and substantially under and around the primary board, the surface contour of the web in both the cross and machine directions experiences undesirable stretching, twisting, and drawing together altering the width of the web during travel. These undesirable web alterations occur due to frictional and drag forces imparted to the web by the applied force pulling the web and the structural elements of the boards which the surface of the web contacts as the web interacts with the boards. Ideally, the width of the web should span both boards illustratively the full 17 inches at all times, even during under- and over-folding of the sections. However, probably due to the utilization of empirical techniques to locate active edges and curves of the secondary and primary boards, past designers of the "W−" type folding board apparently failed to consider many of the structural features which would promote maintaining the full span of the web during all web transitions. Many structural considerations have been incorporated in past boards which do oppose extraordinary stretching, twisting, and repressing the web surface; however, wrinkles and creases in the first and second sections of the webs persist. For nearly a decade wrinkles in the surface of the first sections of "W−" folded webs were common. When a stack of longitudinally-folded web material is compressed during cutting, the wrinkled sections throughout the stack are enhanced. Further, when the cut stacks of wipers are stored in cartons, the wrinkled sections become blocked.

As apparent from the foregoing description of the prior-folding systems, rather extensive modifications to the folding systems for controlling primarily the span of the web in a cross-machine direction are needed to form an improved "W−" type folding board system suitable for producing substantially wrinkle-free sections of the web being longitudinally folded. This search was successful and resulted in the present invention.

The present invention is directed to the improved system which resulted from confronting and solving the basic wrinkling problem for the first and second sections of the web as described above. In the course of the development, additional unforeseen problems were also solved as will be apparent.

SUMMARY OF THE INVENTION

The present invention is concerned with a folding board system for longitudinally folding a web into four equal sections without producing wrinkles and undesirable creases in the folded sections. The fourth section of the web is underfolded under the third section of the web in a conventional manner, utilizing portions of a secondary and a corresponding primary folding board. The first and second sections of the web are initially folded to form doubled sections, and then the doubled sections are guided over and in line with the third section of the web by means of a folding rod and portions of the primary folding board. To prevent the doubled sections from backing up along the folding rod as it is overlaid onto the third section, a novel folding arm is disposed between the folding rod and the primary folding board to oppose any backing up of the doubled sections along the rod. In addition to the addition of the folding arm, the folding edge of the secondary board is disposed to be in actual alignment with the folding rod in order to fully extend a web in both the cross and machine directions, and a flange is added to one side of the primary folding board to provide a radius of curvature equal to the radius of curvature along an opposite side of the primary folding board so as to further control the width span of the web during transitions over the primary folding board.

BRIEF DESCRIPTION OF THE DRAWING

Referring to the drawing figures in which like numerals represent like parts in the several views.

DETAILED DESCRIPTION OF PREFERRED EMBODIMENT

Figure 2:
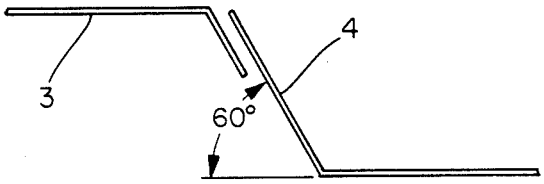
FIG. 2 is a line drawing of a side elevation view of FIG. 1.
Figure 1:
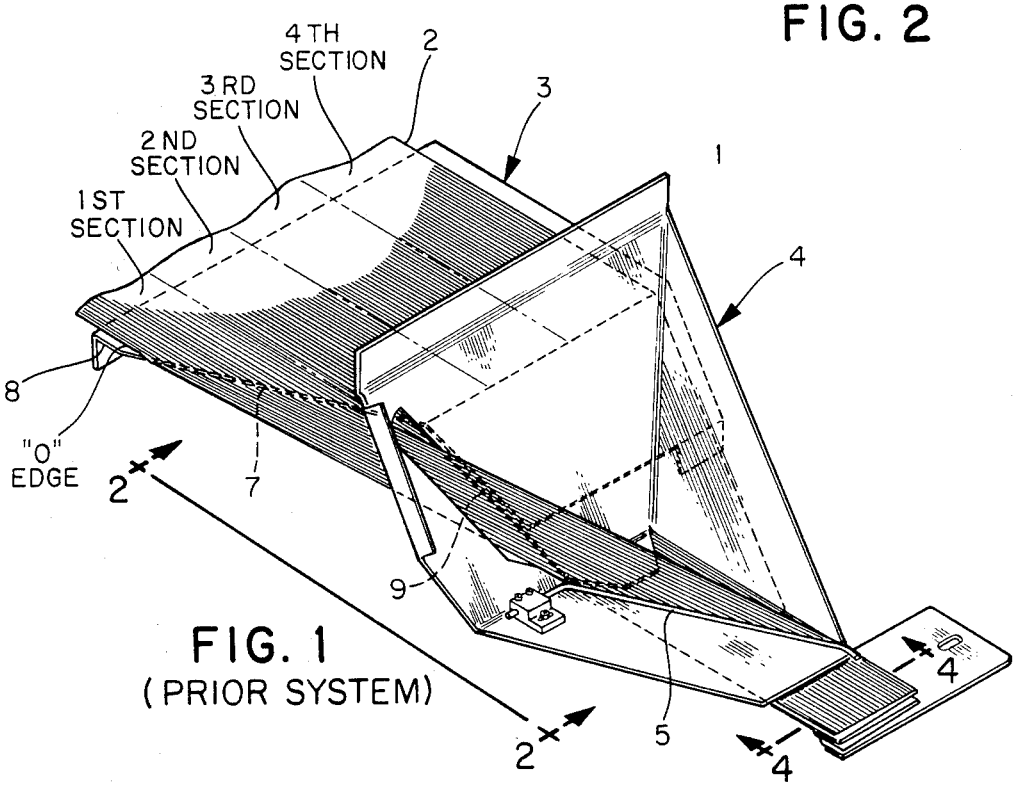
FIG. 1 is a perspective view of a prior folding board system for making longitudinal "W—" type folds in a continuous web.
Figure 3:
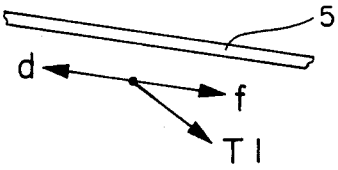
FIG. 3 is a force diagram illustrative of the forces exerted on the web during transitions of a portion of the web over the folding rod which is depicted in FIG. 1.
Figure 4:
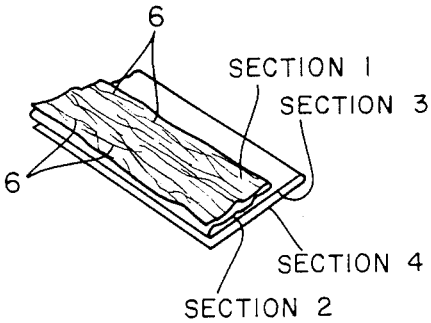
FIG. 4 is a sectional view of a folded web produced by the system shown in FIG. 1.

Before discussing the preferred embodiment, a previous system will be discussed. FIG. 1 illustrates a prior system 1 for forming longitudinal "W—" type folds in a sheet web material 2. System 1 includes a combination of a secondary and a primary folding board 3 and 4 respectively. The primary board 4 includes a folding rod 5 for guiding the doubled sections (the first section in intimate contact with the second section) over the face of the primary board 4 in a manner causing the second section with the accompanying first section to fold over the third section in a direction from left to right when viewed from an operator's side of the machine. The fourth section is underfolded under the third section in the usual manner. The longitudinal folding process is carried out while the web material 2 is drawn forward in the direction indicated by the arrow while under a tensional force T1. The web material 2 is unwound from a storage reel (not shown) and driven by a motorized belt web transfer system (also not shown). The web transferring means create relative motion of the web over the folding boards at speeds sufficient to permit the board to effect the folds yet not rip or tear the web material. However, the first section of web 2 experiences excessive stretching in a machine direction as the first section passes over edge 7 of board 3, and then rotates counterclockwise approximately 90°, edge 7 being exposed approximately 25° with respect to edge 8 of board 3. As shown in FIG. 2, a leading portion of board 4 is inclined 60° with respect to the major surface of board 3, and the first and second sections of the web are traveled about edge 9 of board 4, edge 9 being disposed at about 60° with respect to the top edge of board 3. The doubled first and second sections of web 2 being pulled by tensional force (T1) are routed under folding rod 5 where the frictional force (f) against the surface of the web and the friction between the web and rod causes a drag force (d) to occur which induces a rollback wrinkling effect to sections 1 and 2 of the web. This wrinkling effect reduces total span of the web to some dimension less than the full 17 inches width as the web travels over rod 5. See FIG. 3 which illustrates the forces acting on the web as it passes over rod 5. The excursions of sections 1 and 2 over rod 5 causes nonuniformities in the surface structure, producing the undesirable wrinkles 6—6 as shown in FIG. 4.

Figure 5:
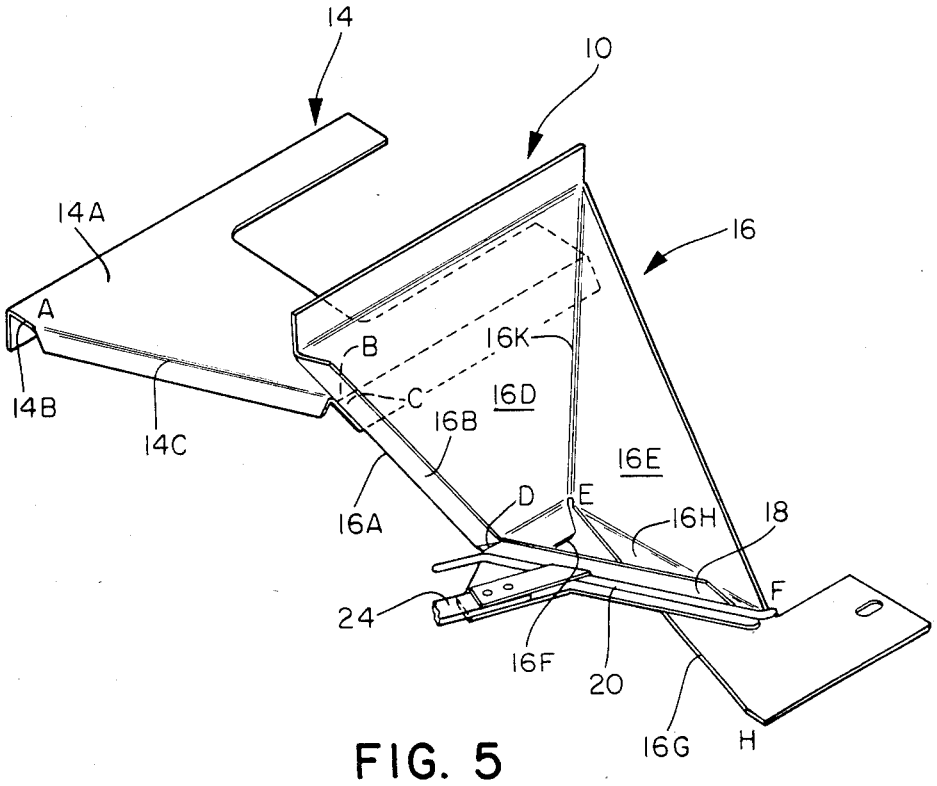
FIG. 5 is a perspective view of a preferred embodiment of the invention.
Figure 6:
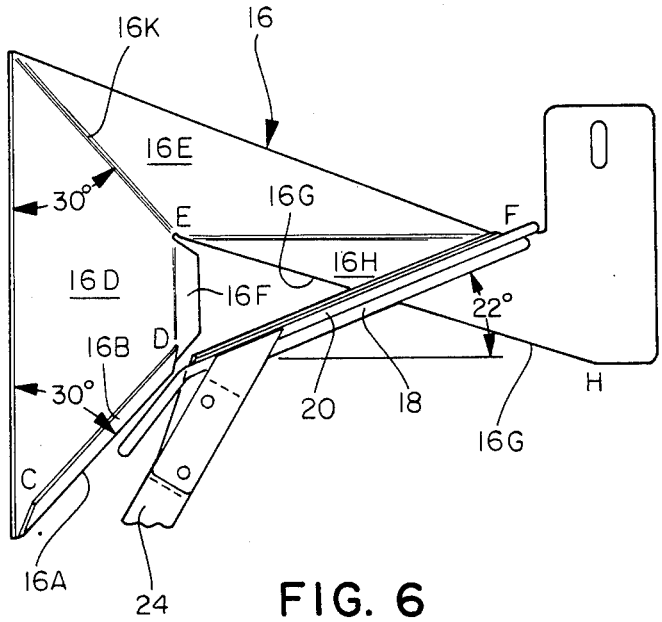
FIG. 6 is a top view of the preferred embodiment.
Figure 7:
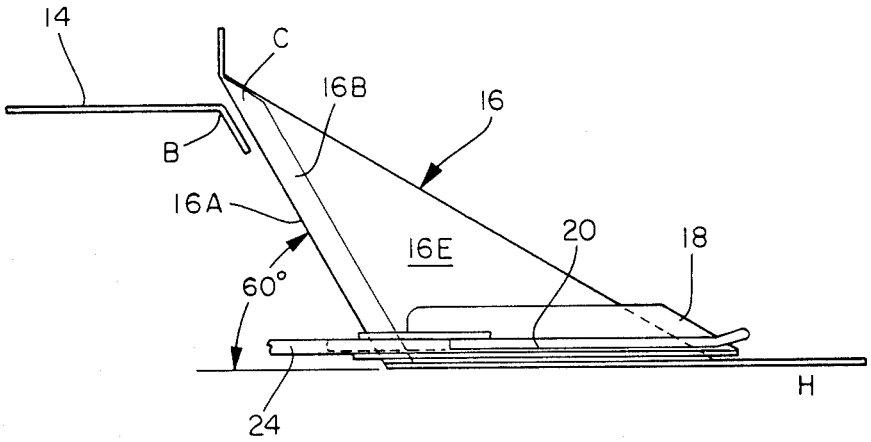
FIG. 7 is an elevated view of the preferred embodiment.
Figure 9:
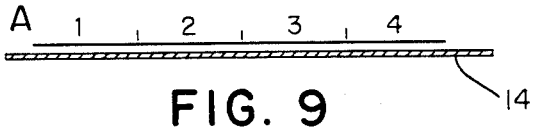
FIGS. 9 through 14 are sectional views illustrating the folding operation at various locations of the folding board system.
Figure 10:
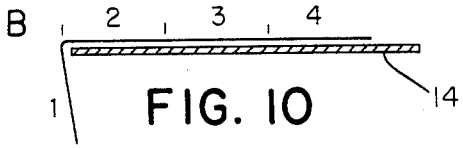
Figure 8:
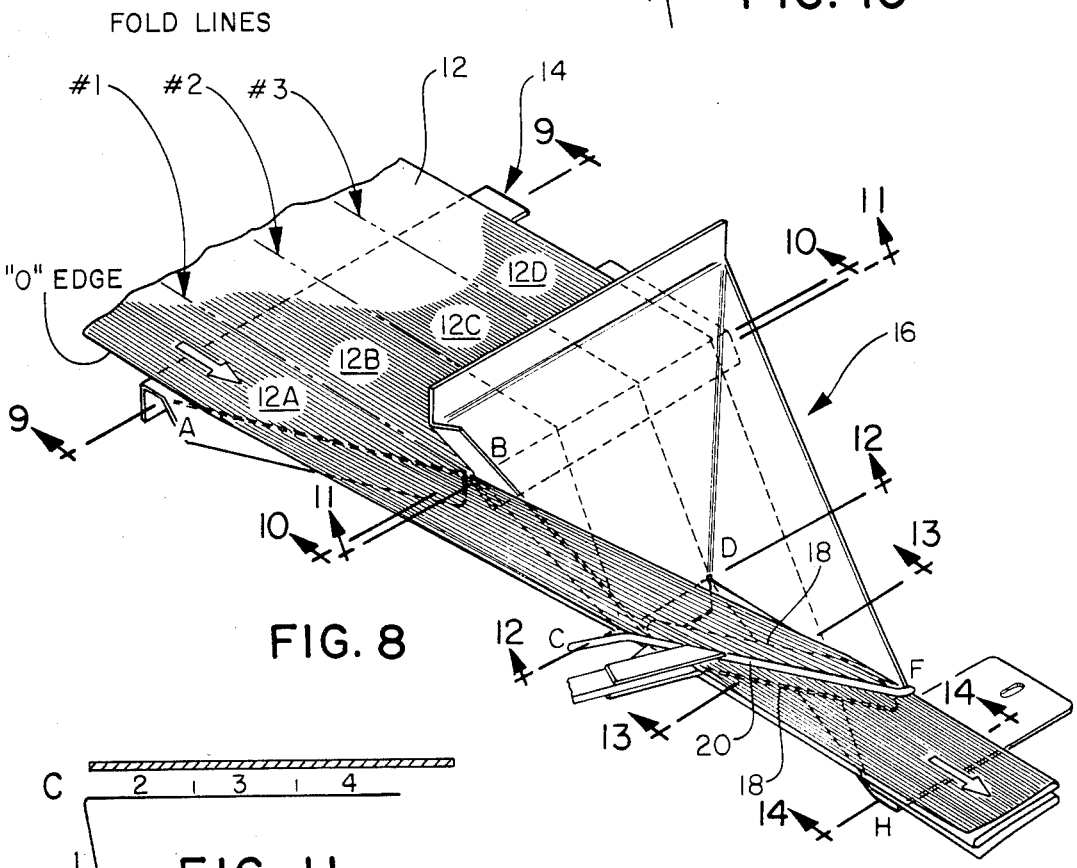
FIG. 8 is a perspective of the preferred embodiment being used to fold a web into the longitudinal "W—" folds.

To provide for keeping the web uniform in both the cross and machine directions, an improved folding board system 10 as depicted in FIG. 5, has been developed. The 30 and 60 degree angle elements of the primary folding board 16 remains the same as the prior system. The edge 14C between points A and B on the secondary folding board 14 has been changed from 25° to 22° to be in line with the folding rod 20, disposed near the primary folding board 16 from a mounting strut 24 position off the board (best seen in FIG. 6). As was noted in prior systems which used just the folding rod to overfold the doubled first and second sections of the web onto the third section, the "rollback" phenomenon occurs about the first folding line between the first and second sections of the web being overfolded. To negate the ability of the first and second sections of the web to slide backwards down the bar (i.e., rollback), a folding arm 18 best seen in FIGS. 6 and 7 was added. Arm 18, being in line with folding rod 20 and spaced apart from rod 20 a chosen distance is mounted near the board 16 by a mounting strut 24 that is positioned off and to one side of the board.

Whenever a section of the web goes around a curved surface or a radius, a drag upon that section of the web is induced; if the radius of the curved surface is very small, the curved surface will tend to cut into the web. Thus to eliminate a small radius on board 16, a first flange 16B is disposed between points C and D, having a radius of curvature equal to the curve about edge 16K, formed between surfaces 16D and 16E respectively.

Refer now to FIGS. 8 through 14. In operation, web 12 which is to be longitudinally folded without developing wrinkles is illustratively 17 inches wide and is sectioned into four $4\frac{1}{4}$ inch widths (namely 12A—12D) by three imaginary fold lines (namely fold line 1, 2, and 3 respectively), the lines being referenced from a "0" line edge.

Web 12 is initially threaded through the folding board system. Web 12 is routed over a face 14A (best seen in FIG. 5) of the secondary folding board 14 with the "0" line edge aligned with longitudinal edge 14B (See FIG. 9). The web is moved parallel with face 14A until it encounters edge 14C at point A. Edge 14C disposed at an acute angle of 22° with respect to edge 14B, extends approximately $11\frac{1}{4}$ inches to point B, point B being a point on board 14 which intersects the imaginary fold line 1. As web 12 is pulled forward from point A toward point B, section 12A changes planes from a horizontal plane through a partial counterclockwise angle or twist of approximately 90° with respect to surface 14A to a substantially vertical plane path of travel. Width measurements of web 12 remain at 17 inches at all cross-sections of the web from point A to point B (See FIG. 10).

Figure 11:
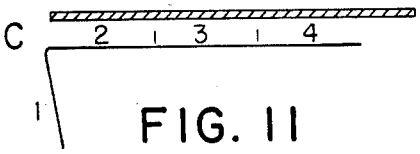
Figure 12:
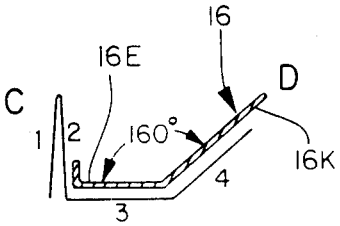
Figure 13:
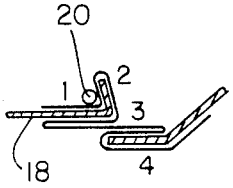
Figure 14:
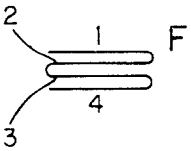

The leading edge of web 12 is routed under a primary folding board 16, with the top surface of the second, third and fourth sections of the web contacting the underside of board 16 from point B toward point C, point C being a point on board 16 which intersects the imaginary fold line 1 (see FIG. 11). From point B fold line 1 portion of web 12 is routed across the board in space above board 16 toward point F, causing section 12A to overlay upon portions of section 12B as those portions of 12B emerge from under board 16, along a first 30° angle converging edge 16A of board 16 (best seen in FIG. 5). Section 12B continues to emerge from under board 16 passing over first flange 16B at an angle of approximately 126° with respect to a central axis of board 16 from point B toward point C forming a doubled section (i.e., the first section 12A overlaying the second section 12B), point C being a point on board 16 that intersects fold line 2. As section 12A is being overfolded over section 12B, doubling the two sections together, section 12D is being folded counterclockwise about a second 30° angle converging edge 16K (best seen in FIG. 5) and on the underside of an obtuse triangular-shaped guide plate 16E that depends at an elevated angle of approximately 126° from the second converging edge (see FIG. 12). Section 12C of the web emerges from under the primary folding board passed a second flange 16F into a horizontal plane path across the top surface of an acute triangular-shaped underfolding guide plate 16H. The guide plate 16H depends from another edge of plate 16E and it causes section 12D to fold under section 12C.

The incline angle of the primary folding board of 60°, the converging 30° edges of the primary folding board along with the 126° elevated guideplate and the 22° folding rod are positioned at these particular angles to complement the transition of the web through the system so as to oppose surface stretches or repressing of the web.

Because the force of gravity acts upon fold line 1 while it is suspended in space, there is a tendency for the surface with cross sections at point C to be slightly less than 17 inches. Hence, from point C to point F, section 12A is routed under folding rod 20 and section 12B is routed under folding arm 18, preventing the surfaces of web 12 along fold line 1 from rolling backwards as the doubled section is moved from point C to F, maintaining the width span of web 12 substantially at 17 inches (see FIG. 13). As sections 12A and 12B are moved along rod 20 and arm 18 respectively, section 12D is folded under section 12C. Section 12C remains under the folding board 16 until the leading edge of section 12C reaches points C and D. From point D, section 12D starts to underfold section 12C as section 12C emerges from under a second flange 16F of board 16, the second flange 16F depending from a central region of board 16 formed between the first and second 30° converging edges 16A and 16K respectively, and continues to underfold along a 17° angle edge 16G, until point H is reached. When Point H is reached, the leading edge of web 12 is completely folded in equal $4\frac{1}{4}$ inch sections in a "W−" type fold (see FIG. 14).

Thereafter threading the web through the folding system 10, continuous longitudinal folded sections will emerge from point H on board 16 as the machine is operated until the length of the web is exhausted. The sections 12A and 12B of web 12 respectively will fall substantially free of any wrinkles. Another result which is achieved is that the sections will be folded substantially along the three fold lines (1, 2 and 3) into equal $4\frac{1}{4}$ inch sections. This folding system has been successfully used to multifold a plurality of webs using both right- and left-hand folding board systems to effect interleaving the plurality of webs.

Figure 15:
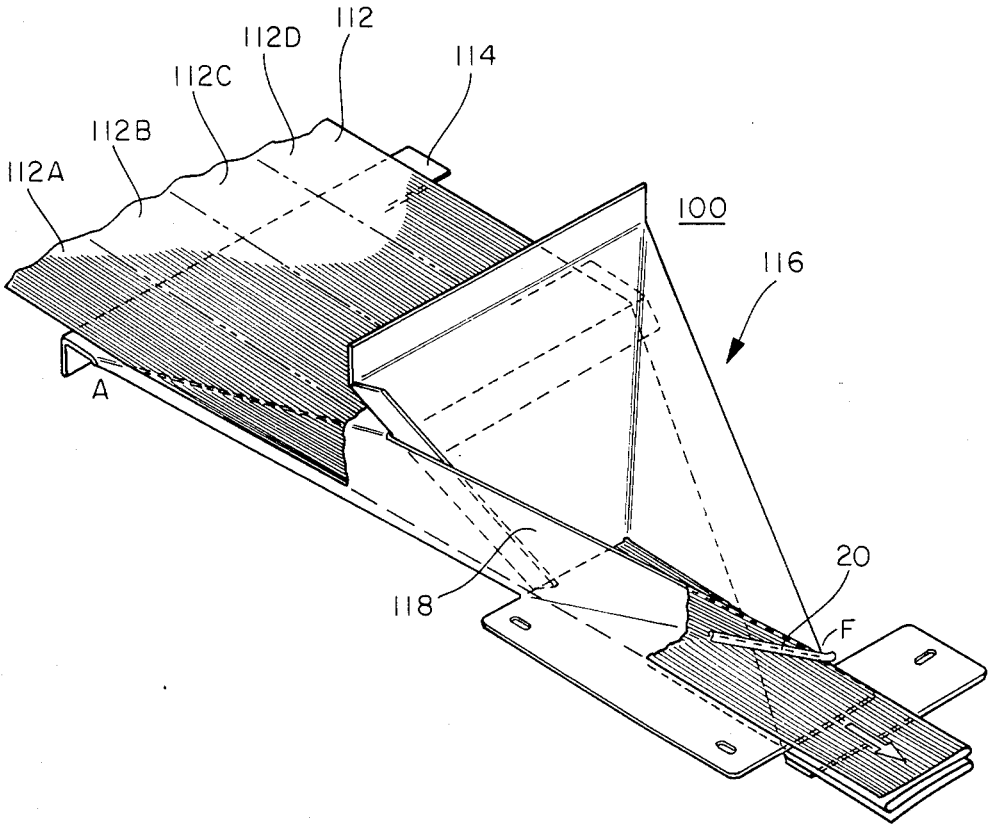
FIG. 15 is a perspective view of a second embodiment of the invention that includes a modified secondary folding board.

A second embodiment of a longitudinal folding board system 100, for longitudinally folding webs, is depicted in FIG. 15. There an extended folding arm 118 depending from the secondary folding board 114 is shown which inserts between sections 112A and 112B of the web with the top edge of the arm contacting fold line 1 as the web is moved between points C and D. This configuration eliminates the effect of gravity upon sections 112A and 112B of the web during excursions between points A and F, but initial threading of the web through the system is extremely difficult.

It is to be understood that the above-described embodiments are mainly illustrative of the principles of the invention. One skilled in the art may make changes in modifications to the embodiment disclosed herein, and may devise other embodiments without departing from the scope and the essential characteristics thereof.

We claim:

1. An improved folding board system for longitudinally folding a moving flexible material web into four equal sections virtually free of undesirable wrinkles in the face of the folded sections, said system providing a balance profile of lateral and longitudinal tension forces upon each section of the web during transitions of the web through said system, said system including a support structure; a secondary folding board disposed on said support structure for initiating folding a first section of the web along a first fold line, said secondary board being positioned in the path of said moving web such that a central axis of said secondary board substantially divides the web in half; the web being moved along a substantial horizontal plane; a primary folding board also disposed on said support structure downstream on an incline from and in alignment with said secondary board for folding a fourth section of the web under a third section of the web, and for cooperating with said secondary folding board to form a double-folded half of the moving web by folding the first section of the web onto the second section of the web as the web moves passed a first converging edge of the primary folding board; and a folding rod disposed at a chosen angle, adjacent to said primary folding board for guiding the double-folded half of the web onto the third section of the web after the third section emerges from under said primary folding board resuming travel in a horizontal plane, forming four substantially equal folded sections in the "W" type fold configuration; said improvement comprising:

a. a diverting edge of said secondary folding board disposed to be in alignment with said folding rod for initiating the fold of the first section of the web;

b. a first flange depending from the first converging edge of said primary folding board at a chosen elevated angle having a radius of curvature along said first converging edge equal to a radius of curvature about a complementary second converging edge of said primary folding board, the second converging edge having an obtuse triangular-shaped guide plate depending therefrom at a chosen angle which complements the elevated angle of said flange for initiating folding the fourth section under the third section, said first flange permitting smooth passage of the double-folded half of the web passed the primary folding boards; and c. a separating means disposed between said folding rod and said first converging edge of said primary folding board for displacing the first section from the second section of the double-folded half of the web as the double-folded half of the web is guided into overlaying relationship with the third section, said separating means also serving to maintain the surface contour of the first and second sections of the moving web substantially fully expanded in both the cross machine and the machine direction in a manner opposing undesirable drag forces between the double-folded half of the web and said folding rod.

2. An improved folding board system as recited in claim 1 wherein the third section of the web emerges from under said primary folding board passed a second flange, said second flange causing travel of the third section in a horizontal direction, the second flange being disposed between the terminal points of the first and second converging edges of said primary folding board.

3. An improved folding board system as recited in claim 1 wherein said separating means is a folding arm.

4. An improved folding board system as recited in claim 3, wherein said diverting edge of the secondary folding board, the incline angle and the first and second converging edges of said primary folding board is in complementary relationship with respect to said folding rod; wherein the inclined angle of said primary folding board with respect to said secondary folding board is approximately 60°, wherein the converging angle of said first and second converging edges is 30° and wherein the diverting edge of said secondary folding board is aligned to be at approximately 22° with respect to a central axis through said secondary folding board, said folding rod being oriented to be in alignment with said diverting edge, said folding arm being spaced between said folding rod and said primary folding board to permit contiguous movement of the first section of the said web between said folding rod and said folding arm while the second section of the web passes over the surfaces of said folding arm.

5. An improved folding board system as recited in claim 4 wherein the proximity of said secondary folding board to the surface of the moving web is such that the first section of said moving web is bent from the plane away from the surface of the remainder of the web without disturbing the substantial parallelism of the central axis of the secondary folding board relative to the surface which includes the central axis of the moving web.

6. An improved folding board system as recited in claim 5 wherein the system formed is a right-hand folding board system.

7. An improved folding board system as recited in claim 5 wherein the system formed is a left-hand folding board system, having the structure disposed as in mirror image relationship with the structure of claim 6, the structure of said secondary folding board said primary folding board, said folding rod and said folding arm being disposed to cause underfolding of the first section of the moving web under the second section while overlaying the third and fourth sections upon the second section of the web.

8. A folding board system for longitudinally folding a moving flexible web into four equal sections without producing undesirable wrinkles in the face of the folded sections, said system maintaining the web substantially fully extended in the cross as well as in the machine directions during transitions of the web through said system, said system comprising in combination:

a. a support structure;

b. a secondary folding board member fixedly mounted on said support structure in the path of the moving web for initiating folding a first section of the web along a first longitudinal fold line axis, said secondary folding board means being positioned in the path of the web such that a central axis of said secondary folding board means substantially divides the web in half, said secondary folding board means including:

i. a diverting edge disposed at a chosen angle for diverting the first section of the web counterclockwise into a substantially perpendicular plane with respect to a horizontal plane of movement of the remainder of the web; and ii. an extended folding arm member depending from said diverting edge, said arm member subject to contact with the underside surfaces of the first section and also with the underside surfaces of a second section of the web for folding the first section along a first longitudinal axis into parallel relationship with the second section forming a double-folded half of the web as the web exits the secondary folding board member;

c. a primary folding board member disposed downstream from and in alignment with said secondary folding board for folding a fourth section of the web under a third section of the web in parallel relationship, and for cooperating with said folding arm member to guide the double-folded half of the web onto the third section of the web, said primary folding board member comprising:

i. a first converging edge;

ii. a first flange member depending from said converging edge at a chosen elevated angle so as to form a particular radius of curvature along said first converging edge for guiding the double-folded half of the web over and onto the third section of the moving web;

iii. a second converging edge spaced a chosen distance from said first converging edge;

iv. an obtuse triangular-shaped guide plate member depending from said second converging edge at an elevated angle which complements the elevated angle of said first flange for guiding the fourth section of the web in a substantially perpendicular elevated plane as the web passes under said primary folding board;

v. a second flange member disposed between the terminal points of said first and second converging edges of said primary folding board for guiding the third section of the web from an incline plane of travel to a horizontal plane of travel;

vi. an acute triangular-shaped underfolding guide plate member depending from another edge of said obtuse triangular guide plate member disposed in a horizontal plane downstream from said second flange member as to guide the fourth section of the web emerging from under said obtuse triangular guide plate member under the third section as the third section emerges from under said second flange member and passes over a top surface of said underfolding guide plate member, said acute triangular-shaped underfolding guide plate member being aligned so as to permit the moving double-folded half of the web to pass from said folding arm member of said secondary folding board member onto parallel relationship with the third and fourth sections passing over the top surface of said underfolding guide plate member; and d. a folding rod disposed in line with a bottom edge of said folding arm for guiding the first section passed the folding arm onto overlaying relationship with the second section as the second section folds over the third action to form a W-type longitudinally folded web.

* * * * *